United States Patent [19]

Cormier

[11] 4,253,758

[45] Mar. 3, 1981

[54] EXTENDER GUIDES FOR PHOTOCONDUCTIVE DRUM REMOVAL

[75] Inventor: Raymond G. Cormier, Nashua, N.H.

[73] Assignee: Nashua Corporation, Nashua, N.H.

[21] Appl. No.: 56,130

[22] Filed: Jul. 9, 1979

[51] Int. Cl.[3] ..... G03G 15/00

[52] U.S. Cl. ..... 355/3 DR; 29/123; 248/544

[58] Field of Search ..... 355/3 R, 3 DR; 248/544; 29/123

[56] References Cited

U.S. PATENT DOCUMENTS

| | | | |
|---|---|---|---|
| 1,671,470 | 5/1928 | Ehrenfeld | 29/123 UX |
| 2,651,241 | 9/1953 | Hornbostel | 29/123 X |
| 2,881,907 | 4/1959 | Pape et al. | 29/123 UX |
| 3,994,053 | 11/1976 | Hunt | 29/123 |
| 4,076,402 | 2/1978 | Kanno et al. | 355/3 DR |
| 4,105,345 | 8/1978 | Van Wagner | 355/30 DR X |
| 4,134,669 | 1/1979 | Reitner | 355/3 DR |

FOREIGN PATENT DOCUMENTS

| | | | |
|---|---|---|---|
| 52-9439 | 1/1977 | Japan | 355/3 DR |

*Primary Examiner*—Fred L. Braun

*Attorney, Agent, or Firm*—Kenway & Jenney

[57] ABSTRACT

A support structure located in the interior of an electrophotographic copier photoconductive drum to guide removal of the drum from its rotational shaft while eliminating potentially injurious radial movement, has extender guides which can protrude from the end of the drum to provide an effective continuation of the guiding surface provided by the support structure. Each guide, upon which the inner surface of the drum will ride during removal, can, during normal operation of the copier, be held in an inoperative position within the drum interior. The outwardly protruding ends of the guides also can be beveled or tapered to facilitate reinstallation of the drum into its operating position within the copier.

10 Claims, 6 Drawing Figures

EXTENDER GUIDES FOR PHOTOCONDUCTIVE DRUM REMOVAL

BACKGROUND OF THE INVENTION

The present invention relates generally to the field of electrophotographic copiers and more specifically to apparatus for aiding in the insertion and removal of photoconductive drums from such copiers.

In an electrophotographic copier, in which a rotating drum with a photoconductive outer surface is used for creation of a latent electrostatic image, occasionally it becomes necessary to remove the drum in order to permit access for normal maintenance of the copier, to replace a worn out drum or otherwise restore it to its original optimum operating condition. In the normally cramped confines of the copier, in which a multitude of drum interacting components are necessarily close to the photoconductive surface, sometimes within a fraction of an inch, removal of the drum with its fragile surface presents several problems. Usually, the drum is removed from its rotational shaft by sliding it in an axial direction until it has been completely disengaged therefrom. Because of the tight conditions within the copier, any radial movement of the drum during removal can cause it to come into contact with one or more of the other operating components. This can result in either damage to the other components or even irreparable damage to an otherwise reusable drum. This radial movement is practically unavoidable unless removal and replacement are guided by appropriate means.

One structure for removing the drum uses guide rollers in contact with the fragile drum surface and in conjunction with a drum-enclosed support structure. Since the photoconductive surface is extremely fragile, the likelihood of potential damage to the drum through contact with the rollers can be very high, and even a small defect in the photoconductive surface can preclude its use.

It is therefore an object of this invention to provide drum removal guide apparatus which provides no contact with the fragile photoconductive surface of the drum and therefore cannot damage that surface.

Other objects of this invention are to provide a drum removal guide apparatus which can be adapted simply and economically to the existing structure of conventional copiers, and which is reliable, maintenance-free, and easy to use.

It is a further object of the present invention to provide drum removal guide apparatus without adding to the congestion in the area surrounding the drum.

SUMMARY OF THE INVENTION

The present invention relates to an apparatus for use in a photocopier having a rotatable drum member, to aid in the axial removal of the drum member from its operating position in the photocopier. The apparatus features a drum support structure for supporting the drum in its operating position for axial rotation, and a drum guide device supported by the drum support structure for movement between an inoperative stored position wherein the guide device is maintained within the drum interior and an operative guiding position wherein the guide device is positioned for guiding removal of the drum member.

In a preferred embodiment of the invention the drum guide device features extender guides which slidably engage the drum support structure and are urged outwardly toward the operative position by springs. During normal operation of the copier a cover over the end of the drum holds the guides in the inoperative stored position. When the end cover is removed, each of the spring-urged extender guides automatically will assume the operative position and effectively will provide a continuation of the support structure extending beyond the end of the drum. As the drum is moved in an axial direction from its central shaft, its inner surface will ride on the support structure and then on the extender guides until it is safely removed from the central shaft and from the interior of the copier.

When it is desired to install a new or repaired drum in the copier, the extender guides will perform a similar function, only in reverse order. In a preferred embodiment the outermost ends of the extender guides can be beveled or tapered to present a slightly smaller cross-sectional area, making insertion of the guides into the drum opening easier. The upwardly sloping edges created by the bevel or taper will direct the drum securely onto the extender guides and from there onto the support structure itself. Once the drum has assumed its final position, the end cover is replaced, to push the extender guides against their springs into their inoperative position.

As is evident, there is little likelihood of contact between the fragile photoconductive surface and any support or guide mechanism during either removal or replacement of the drum. All supportive contact is designed to be provided only to the interior surface of the drum and therefore shortcomings of prior art removal devices have been overcome.

BRIEF DESCRIPTION OF THE DRAWINGS

Other objects, features, and advantages of the invention will appear from the following description of a preferred embodiment and the drawings in which.

DESCRIPTION OF A PREFERRED EMBODIMENT

Figure 1:
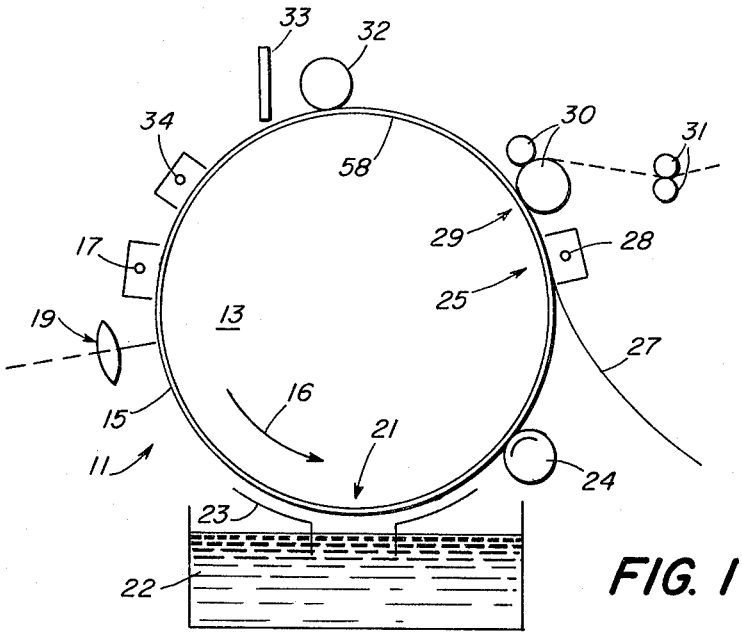
FIG. 1 is a schematic front elevation view of a photocopier in which the present invention is incorporated.

Referring to FIG. 1, a typical photocopier 11 in which the present invention can be employed has a drum 13 with a photoconductive surface 15 thereon rotating in the direction indicated by an arrow 16. A charge corona 17 located in close proximity to drum 13 charges the photoconductive surface to about +1000 volts DC. An optical system indicated generally at 19 focuses an image onto the drum and the light causes conduction in photoconductive surface 15 so as to form a latent electrostatic image comprising a pattern of electrical charges on surface 15. The rotating drum 13 transports the latent image to a development station 21 where a liquid developer 22 having a negatively charged toner will contact the electrostatic image to develop it. A development electrode 23 having a positive electrostatic charge of appropriate magnitude is located close to surface 15 and serves to counteract any residual background voltage remaining on the drum surface. A counter-rotating metering roll 24 removes excess liquid. Surface 15, bearing the now-developed image, proceeds to a transfer station 25 where the image will be transferred to a copy material 27. A transfer corona 28 also in close proximity to the drum surface applies a positive charge to the backside of the copy material 27 and causes the negatively charged toner particles to be attracted to the surface of the copy material 27. During this process, copy material 27 makes actual contact with surface 15 and then must be removed from the surface at 29 and be led away from the drum along a path defined by rollers 30 and 31. After transfer, there generally remains on the drum a residue of liquid developer. The surface 15 is cleaned continuously of this residue by a cleaning roller 32 and a cleaning blade 33. Finally, the surface is electrically neutralized prior to the next copying cycle by a high voltage A. C. neutralizing charge from a discharge corona 34. It is precisely the congested condition due to the array of components closely situated to the drum that makes removal of the drum for maintainence, repair, or replacement such a potentially painstaking operation. Any inadvertent movement of the drum in the direction radial to its axis of rotation may cause contact with one of the closely situated components and either damage the components themselves or permanently mar the fragile photoconductive surface.

Figure 2:
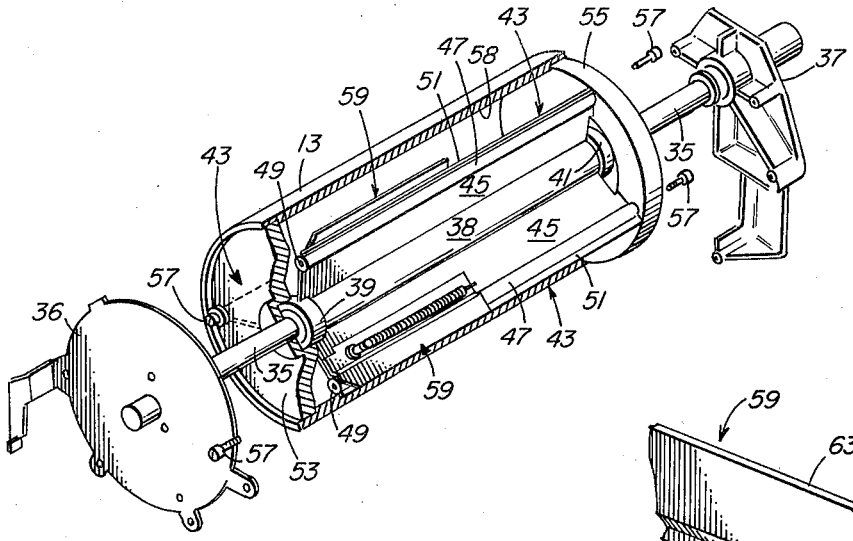
FIG. 2 is a perspective view, in cut-away, of the photoconductive drum and the internal support structure therefor during normal copier operating conditions.
Figure 3:
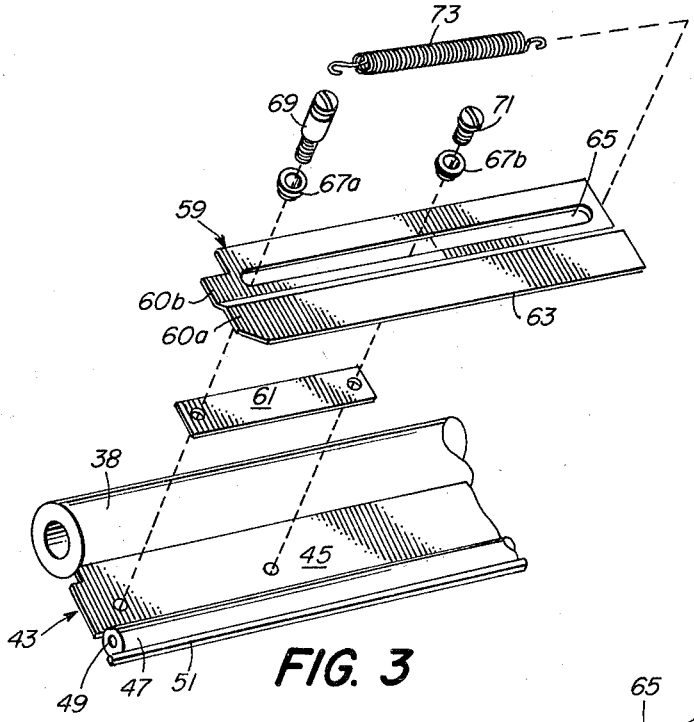
FIG. 3 is an exploded detail view of an extender guide, depicting the structure by which it is mounted to the support member.

In FIG. 2, a central shaft 35 extends along the entire length of drum 13, protrudes through both ends thereof, and is supported at opposite ends by brackets 36 and 37, which brackets are mounted to the main housing of the copier (not shown). A central hub 38 encircles shaft 35 and is able to rotate about said shaft by means of bearings 39 and 41. Extending outwardly from hub 38 are three support members 43, which are of essentially the same length as hub 38. The illustrated support members 43 are spaced equidistantly around the circumference of hub 38 but this spacing, although preferred, is not required for the proper operation of the present invention, nor is the limitation to only three such members. Each support member includes a planar portion 45 (see also FIG. 3) and an integrally formed tubular portion 47, the tubular portion 47 having a threaded inner bore 49 at each end thereof and a smooth, straight outermost surface 51, which surface is generally parallel to shaft 35. The entire assembly consisting of hub 38, planar portions 45 and tubular portions 47 can be formed from a single casting or extrusion, or can be assembled by rigidly bonding together the component elements. Drum 13 and support members 43 are held in a fixed spatial relationship by end covers 53 and 55. Covers 53 and 55 tightly engage the openings at either end of the drum and are rigidly attached to support members 43 by screws 57 which engage the threaded bores 49 of tubular portions 47. With the covers properly in place, as shown in FIG. 2, a clearance of several thousandths of an inch is maintained between the outer surfaces 51 of tubular portions 47 and the inner surface 58 of the drum. Thus the drum is not directly resting on any portion of the support members 43 during normal operation of the copier.

Figure 4:
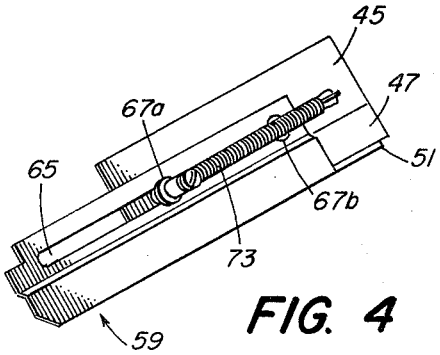
FIG. 4 is a detail view of an extender guide in the operative position.

Slidably mounted on each planar portion 45 of a support member 43 is an extender guide 59. As shown more clearly in FIG. 3, each guide is shaped to conform generally to the contour of the underlying support member 43 so that an outer segment **60*a* slides directly against tubular portion 47 while an inner segment 60*b* slides against a thin spacer 61 intermediate the guide 59 and planar portion 45. Each guide has a generally straight outer edge 63 and a longitudinal slot 65 parallel to edge 63, the slot extending along almost the entire length of guide 59. Each guide 59 is held in slidable contact against a corresponding tubular portion 47 and spacer 61 by flanged sleeves 67*a* and 67*b* which protrude through longitudinal slot 65 and which are themselves held in place by screws 69 and 71, the screws passing through spacer 61 and being anchored in planar portion 45. Sleeves 67*a* and 67*b*, through their engagement with slot 65, serve as guides for directing the movement of guides 59, and as stops for limiting the extent of movement of the guides. Sleeves 67*a* and 67*b* are positioned such that edge 63 of the guide will be aligned radially with outer surface 51, and will remain aligned as the guide is slid in the direction parallel to the drum axis. The phrase "aligned radially" signifies that along the entire length of the edge 63, this straight edge is lined up with the straight outer surface 51 and neither extends radially beyond surface 51 toward drum inner surface 58 (see also FIG. 2), nor stops short of reaching surface 51. A spring 73 connects between screw 69 and the end of guide 59, and urges guide 59 toward the left. This corresponds to the direction of drum removal. Referring to FIG. 4, guide 59, in the absence of a physical restraint, moves as far as possible to the left, sufficient to protrude beyond the end of the drum, until stopped by sleeve 67*b*. In the illustrated embodiment (FIG. 2), end cover 53 provides this physical restraint, so that during normal operation of the copier, extender guides 59 are held or maintained in an inoperative position within the interior of drum 13**.

Figure 5:
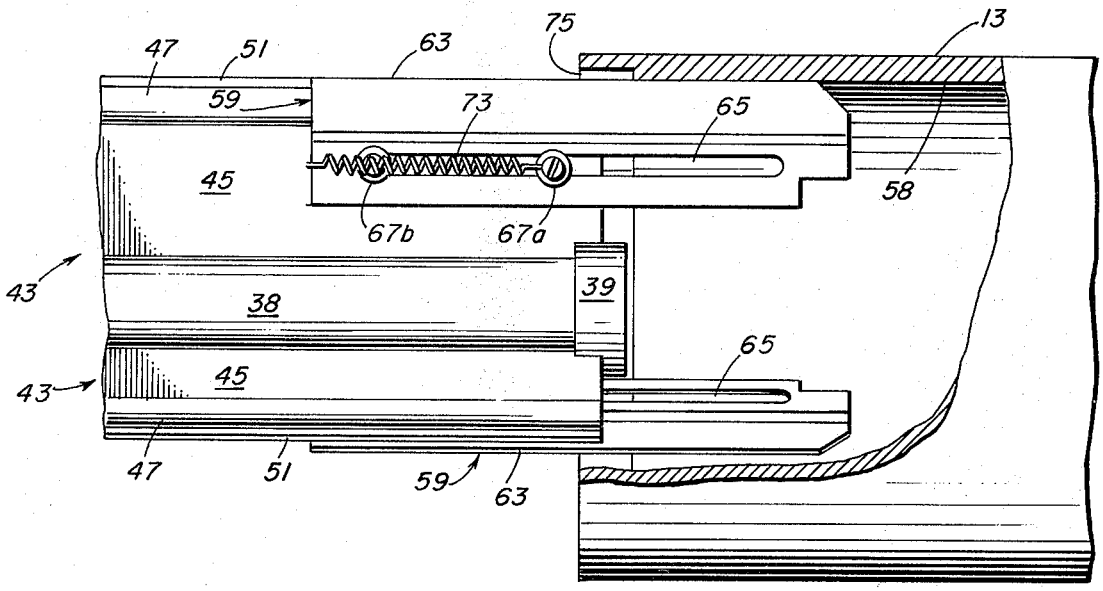
FIG. 5 is a side elevation view, in cut-away, of the drum showing its interrelationship with the extender guides during a typical drum removal procedure.

FIG. 5 shows how the extender guides aid in removal of drum 13. The end cover 53 and shaft support bracket 36 (see FIG. 5) have been removed, and guides 59 are fully extended. The drum 13 has been moved axially a considerable distance from its original position to the right and rides on the surface 51 of tubular portion 47 and the radially aligned edge 63 of guide 59. Since in the operative position of the drum there was only several thousandths of an inch clearance between the drum interior and surfaces 51 of the circumferentially arranged support members, there is no appreciable radial movement of the drum during the drum removal process. In the absence of guide 59, in the removal position depicted in FIG. 5, the trailing edge 75 of the drum would be encompassing only the axially outermost ends of support members 43 and the drum would be able to pivot about its axis and in the radial direction. Since the drum would not yet have advanced to a point where it was clear of all potentially damaging interference, any radial movement still could mar the drum surface. Instead however, according to the invention, guides 59 have effectively extended the drum support to minimize damaging radial movement until the drum is clear of the drum cavity.

Figure 6:
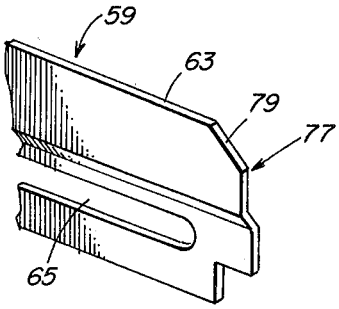
FIG. 6 is a fragmentary detail view of the beveled end of an extender guide.

The guides are equally helpful in reinstalling the drum. To facilitate engagement of the guides with the only fractionally larger drum opening, the edges of the guides are, in the illustrated embodiment, beveled (FIG. 6). The reduced height of the guides at edge 77 makes it easier for the drum to encompass the ends of the guides, and the gradually sloping surface 79 will direct the drum into full contact with surface 63 of the guide.

SUMMARY OF THE ADVANTAGES OF THE INVENTION AND NON-OBVIOUSNESS

The drum-removal extender guides according to the present invention provide several distinct advantages over many commercially used prior art devices. They are not external to the photoconductive drum and, by completely avoiding contact with the outer drum surface, they present no additional opportunity for damage to that surface. The location of the extender rails within the interior of the drum eliminates any need to rearrange the copier components in the vicinity of the drum to make room for the installation of a removable apparatus. The guides can be adapted easily and economically to typical internal drum support structures presently found in conventional copiers, and will provide a reliable, maintenance-free removal apparatus.

The drum removal guides described herein are significantly different from prior art devices. For example U.S. Pat. No. 4,076,402 to Kanno et al. discloses roller mechanisms disposed externally to the drum to aid in drum removal, whereas the present invention discloses a mechanism internal to the drum and contacting the interior of the drum. Thus the structure for providing removal means, whether rolling, sliding or otherwise as described herein is not described or taught in Kanno.

Furthermore, Kanno provides for an elastic material for that part of the roller which contacts the outer drum surface to avoid damaging the drum surface. Nevertheless, any such contact offers a potential for damage, so that elimination of this condition offers definite advantages.

Furthermore, dust or dirt build-up on any exposed parts could cause them to bind, or become dirty and hence mar or otherwise damage the drum. In the present invention, the extender guides are unlikely to bind in their retracted position or become dirt-covered because they are shielded from dirt to a great extent within the closed drum. But despite any imperfections that might develop with the guides, there is still no possibility of damage to the photoconductive surface from the very apparatus which is intended to prevent such damage in the first place.

Modifications of the disclosed embodiment are contemplated and would be within the scope of the invention. For example the invention is equally applicable to either a liquid- or a dry-toner copier. The extender guides could move in a different fashion relative to the support members than by sliding parallel thereto, for example by pivoting, as long as there was proper radial alignment between the support surfaces of the guides and the support members when the guides were in their operative position. In the operative position, each guide may be circumferentially or axially offset from the respective support member, although still attached thereto, provided the radially outermost surfaces of each remain substantially aligned in the radial direction.

The guides could provide any one of a variety of rolling surfaces, rather than a sliding one, on which the drum would ride. The guides could be moved from the inoperative to the operative positions by urging means other than a spring, or even by manual operation. The extender guides may be retracted into a cavity within the support members, rather than slide on the exterior surface thereof. Thus additions, subtractions, deletions and other modifications of the disclosed embodiment will be obvious to those skilled in the art and are within the scope of the following claims.

What is claimed is:

1. In a photocopying apparatus having a rotatable drum member, apparatus for aiding in the axial removal of said drum member from its operating position in said photocopying apparatus, comprising: ;p1 a drum support means for supporting said drum in said operating position for axial rotation; and a drum guide means having a drum guide surface, said guide means being supported by said drum support means for movement between an inoperative stored position wherein said guide means is maintained within the drum interior, and an operative guiding position wherein said guide means is positioned for guiding removal along said guide surface of said drum member from said support means.

2. The drum removal aiding apparatus as set forth in claim 1 wherein said drum guide means further comprises at least one member slidable on said drum support means between said inoperative position and said operative position, said slidable member having a said guide surface which is a radially outward surface substantially parallel to the drum axis, upon which said drum travels during removal of said drum.

3. In a photocopying apparatus having a rotatable drum member, apparatus for aiding in the axial removal of said drum member from its operating position in said photocopying apparatus, comprising:

a drum support means for supporting said drum in said operating position for axial rotation, a drum guide means supported by said drum support means for movement between an inoperative stored position wherein said guide means is maintained within the drum interior, and an operative guiding position wherein said guide means is positioned for guiding removal of said drum member from said drum support means, wherein said drum guide means includes at least one member slidable on said drum support means between said inoperative position and said operative position, said slidable member having a radially outward surface substantially parallel to the drum axis, upon which said drum travels during removal of said drum, and means for automatically urging each said slidable member toward said operative position.

4. The drum removal aiding apparatus as set forth in claim 3 wherein said urging means comprises a spring element connected between said slidable member and said drum support means.

5. The drum removal aiding apparatus as set forth in claim 3, further comprising means for maintaining said slidable member in said inoperative position against the influence of said urging means.

6. The drum removal aiding apparatus as set forth in claim 5, wherein said maintaining means comprises a drum cover for engaging an open end of said drum and for blocking movement of said slidable member from said inoperative position to said operative position, and means for securing said drum cover to said drum support means.

7. In a photocopying apparatus having a rotatable drum member, apparatus for aiding in the axial removal of said drum member from its operating position in said photocopying apparatus, comprising:

a drum support means for supporting said drum in said operating position for axial rotation, a drum guide means supported by said drum support means for movement between an inoperative stored position wherein said guide means is maintained within the drum interior, and an operative guiding position wherein said guide means is positioned for guiding removal of said drum member from said drum support means, means for urging said drum guide means from said inoperative to said operative position, and means for maintaining said drum guide means in said inoperative position at least when said drum is rotating during normal operation of said photocopying apparatus.

8. In a photocopying apparatus having a rotatable drum member, apparatus for aiding in the axial removal of said drum member from its operating position in said photocopying apparatus, comprising:

a drum support means for supporting said drum in said operating position for axial rotation, a drum guide means supported by said drum support means for movement between an inoperative stored position wherein said guide means is maintained within the drum interior, and an operative guiding position wherein said guide means is positioned for guiding removal of said drum member from said drum support means, means for maintaining said drum guide means in said inoperative position at least when said drum member is rotating during normal operation of said photocopying apparatus, and means for positively maintaining said drum guide means in said operative position.

9. In a photocopying apparatus having a drum member rotatable about a central shaft, apparatus for aiding in the removal of said drum member, comprising:

a hub member rotatably engaging a portion of said central shaft within said drum;

a plurality of radially extending support members fixedly attached to said hub and equidistantly spaced thereabout, said support members having raidally outermost surfaces disposed close to, but not touching, the inner circumferential surface of said drum when the drum is in an operative position in said photocopying apparatus;

a plurality of extender guide members, each of which slidably engages a separate one of said support members, said guide members being slidable in a direction generally parallel to said central shaft and having an inoperative stored position within the drum interior, and an operative guiding position wherein said guide members protrude through an end opening of said drum in radial alignment with said radially outermost surfaces;

a spring connected between each of said guide members and the respective support member to urge said guide members toward said operative position; and an end cover removably secured to said drum at said end opening for holding said guide members in said inoperative stored position.

10. In a photocopying apparatus having a drum member rotatable about a central axial support member, apparatus for aiding in the axial removal of said drum member from its operating position in said photocopying apparatus, comprising;

drum guide means carried on said central axial support member, said drum guide means having a drum guide surface and being movable between an inoperative stored position wherein said guide means is maintained within the drum interior, and an operative guiding position wherein said guide means guide surface is positioned for guiding removal of said drum member from said central axial support member.

* * * * *